US008950097B2

(12) United States Patent
Sugg et al.

(10) Patent No.: US 8,950,097 B2
(45) Date of Patent: Feb. 10, 2015

(54) AUTOMATIC WEAPON MAGAZINE, CHARGING HANDLE, BOLT CARRIER, BOLT CATCH, SCOPE, AND BOLT FEATURES AND METHODS OF OPERATION

(71) Applicants: Edward A. Sugg, South Riding, VA (US); David W. Sugg, Ashburn, VA (US)

(72) Inventors: Edward A. Sugg, South Riding, VA (US); David W. Sugg, Ashburn, VA (US)

( * ) Notice: Subject to any disclaimer, the term of this patent is extended or adjusted under 35 U.S.C. 154(b) by 0 days.

(21) Appl. No.: 13/875,078

(22) Filed: May 1, 2013

(65) Prior Publication Data

US 2014/0150639 A1 Jun. 5, 2014

Related U.S. Application Data

(60) Provisional application No. 61/641,118, filed on May 1, 2012.

(51) Int. Cl.

| | |
|---|---|
| ***F41A 3/12*** | (2006.01) |
| ***F41A 5/18*** | (2006.01) |
| ***F41A 5/20*** | (2006.01) |
| ***F41A 3/16*** | (2006.01) |
| ***F41A 3/66*** | (2006.01) |
| ***F41A 3/72*** | (2006.01) |
| ***F41A 17/38*** | (2006.01) |
| ***F41A 17/64*** | (2006.01) |
| ***F41A 35/06*** | (2006.01) |
| ***F41G 1/38*** | (2006.01) |
| ***F41A 3/68*** | (2006.01) |
| ***F41G 3/08*** | (2006.01) |

(52) U.S. Cl.

CPC ... *F41A 5/20* (2013.01); *F41A 3/16* (2013.01); *F41A 3/66* (2013.01); *F41A 3/72* (2013.01); *F41A 17/38* (2013.01); *F41A 17/64* (2013.01); *F41A 35/06* (2013.01); *F41G 1/38* (2013.01); *F41A 3/68* (2013.01); *F41G 3/08* (2013.01)

USPC ..... 42/16; 89/191.01

(58) Field of Classification Search

CPC ..... F41A 3/12

USPC ..... 42/16, 14; 89/193, 179, 185, 180, 183, 89/17, 130, 156, 194, 191.01

See application file for complete search history.

(56) References Cited

U.S. PATENT DOCUMENTS

| | | | | |
|---|---|---|---|---|
| 5,551,179 | A * | 9/1996 | Young | 42/16 |
| 7,316,091 | B1 * | 1/2008 | Desomma | 42/16 |
| 8,297,175 | B1 * | 10/2012 | Davies | 89/191.01 |
| 8,387,513 | B2 * | 3/2013 | Gomez et al. | 89/191.01 |
| 8,746,125 | B2 * | 6/2014 | Gomez et al. | 89/191.01 |

(Continued)

OTHER PUBLICATIONS

International Search Report dated May 19, 2014 issued in International Patent Application No. PCT/US13/39133.

*Primary Examiner* — Reginald Tillman, Jr.

(74) *Attorney, Agent, or Firm* — Arent Fox LLP

(57) ABSTRACT

A magazine well for a firearm having an angled spine receiving portion. A charging handle for a firearm having latch that extends below a bottom surface of a crossbar. A bolt carrier for a firearm having a pair of vent holes disposed in the indented portion and at least one additional vent hole on indented portion adjacent to the pair of vent holes. A bolt catch for a firearm having a receiving portion curved to match the contours of a human thumb. A scope assembly for a firearm having markers on a scope and amount that correspond to the same radial positions. A bolt for a firearm having a plurality of ribs disposed on a main body and extending from a front end toward a tail portion of the bolt.

8 Claims, 16 Drawing Sheets

(56) References Cited

U.S. PATENT DOCUMENTS

| | | | | |
|---|---|---|---|---|
| 2010/0154275 | A1 | 6/2010 | Faifer | |
| 2011/0094136 | A1 | 4/2011 | Zimmerman | |
| 2011/0185617 | A1 | 8/2011 | Brixius | |
| 2012/0073176 | A1 | 3/2012 | McManus et al. | |
| 2012/0137872 | A1* | 6/2012 | Crommett | 89/193 |

* cited by examiner

AUTOMATIC WEAPON MAGAZINE, CHARGING HANDLE, BOLT CARRIER, BOLT CATCH, SCOPE, AND BOLT FEATURES AND METHODS OF OPERATION

This application claims priority to U.S. Provisional Patent Application No. 61/641,118, entitled "Automatic Weapon Magazine, Charging Handle, Bolt Carrier, Bolt Catch, Scope, and Bolt Features and Methods of Operation," filed on May 1, 2012, the entirety of which is hereby incorporated by reference herein.

BACKGROUND OF THE INVENTION

1. Field of the Invention

Aspects of the present invention relate to automatic and semi-automatic firearms, such as M-4 or AR-15 firearms, and more particularly to mechanical enhancements to improve faster reload, smoother firing, a reduced failure rate, and easier operation, for example.

2. Background

The basic mechanical structure of AR-15, M-16, HK 416, HK 417, HK MR556, FN SCAR, and SIG 516, among other similar firearms, is known in the art. FIG. 1 shows an exploded view of a standard AR-15, which serves as an example of a firearm to which the inventive improvements disclosed herein may be applied. As shown in FIG. 1, the AR-15 firearm 10 includes, among other elements, a buttstock 12, a lower receiver 14, a handle 16, a magazine well 18, a magazine 20, a trigger 22, a barrel 24, a bolt carrier 26, a bolt 28, a firing pin 30, a charging handle 32, an upper receiver 34, a gas tube 36, a bolt catch 38, a sight 40, gas rings 42, a magazine catch 44, and a magazine release button 46. Standard operation of the AR-15 firearm is well known in the art.

There are multiple flaws with existing automatic and semi-automatic weapons of the AR-15 type, which my lead to magazine loading difficulty, catastrophic failure due to charging handle malfunctions, failure due to bolt carrier malfunctions, and other areas that lead to unsustainable firing rates. These flaws can, among other problems, result in life threatening consequences in battle or decreased performance during competitions.

There remains a need in the art for firearms of the direct impingement and piston type that allow for faster reload, more controllable firing rate, a reduced failure rate, and easier operation, as compared to current semi-automatic or automatic type firearms.

SUMMARY OF THE INVENTION

Aspects of the present invention provide, among other things, improvements on various elements of a firearm, including a magazine well, a charging handle, a bolt carrier, a bolt, a bolt catch, a scope, and an upper receiver cleaning device.

In one example variation, the magazine well includes a plurality of walls forming a cavity shaped to receive a magazine; and a magazine spine receiving portion extending along one of the walls, wherein the magazine spine receiving portion includes an angled portion angled relative to a longitudinal line extending along the wall having the spine receiving portion.

In another variation, the charging handle includes a front end and a rear end; a body extending from the front end to the rear end; a crossbar disposed at the front end, the crossbar having a bottom surface defining a horizontal plane; and a latch being operatively connected to the body, wherein the latch extends below the horizontal plane.

In another variation, the bolt carrier includes a front end and a rear end; a main body extending from the front end to the rear end; an indented portion; a pair of vent holes disposed in the indented portion and aligned such that a vertical line passes through each of the vent holes, wherein the vertical line divides the indented portion into a first portion on a side of the vertical line closer to the front end and a second portion on a side of the vertical line closer to the rear end; and at least one additional vent hole disposed on the first portion of the indented portion.

In yet another variation, the bolt includes a front end and a rear end; a main body extending from the front end to the rear end; a tail portion disposed at the rear end; a plurality of lugs disposed on the main body at the front end; and a plurality of ribs disposed on the main body and extending from the front end toward the tail portion.

In another variation, the bolt catch includes a release mechanism; and a receiving portion curved to match the contours of a human thumb.

In another variation, the scope assembly includes a main body having a cylindrical portion; a lens disposed within the main body; a power adjuster, an elevation adjuster, and a windage adjuster, each coupled to the main body; a mount for mounting the main body to the firearm; and at least one marker disposed on a surface on the main body and at least one marker disposed on a surface of the mount, wherein the at least one marker disposed on the main body and the at least one marker disposed on the mount correspond to the same radial position on the respective surfaces.

In another variation, the cleaning device includes a main body having a substantially cylindrical shape and a circular cross section; and a projection portion extending in a first direction along the length of the main body and extending in a second direction away from the main body, wherein the projection portion has substantially rectangular shape with a square cross section.

Additional advantages and novel features of various aspects of the present invention will be set forth in part in the description that follows, and in part will become more apparent to those skilled in the art upon examination of the following or upon learning by practice thereof.

DETAILED DESCRIPTION

Aspects of the present invention provide, among other things, improvements on various elements of a firearm, including a magazine well, a charging handle, a bolt carrier, a bolt catch, a scope, and an upper receiver cleaning device.

Magazine Well

Figure 1:
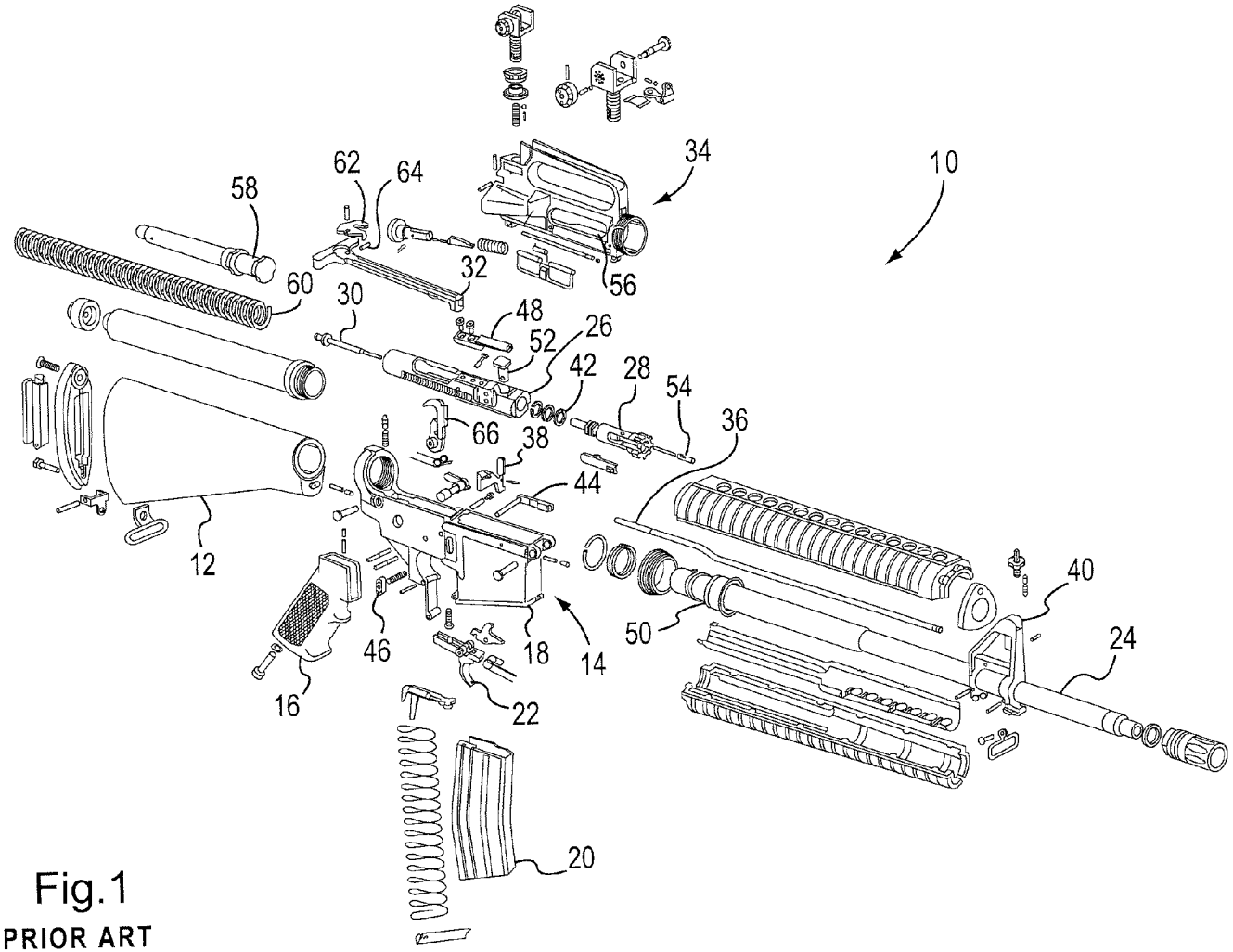
Fig.1 PRIOR ART
FIG. 1 shows an exploded view of an example AR-15 firearm usable in accordance with aspects of the present invention.
Figure 2A:
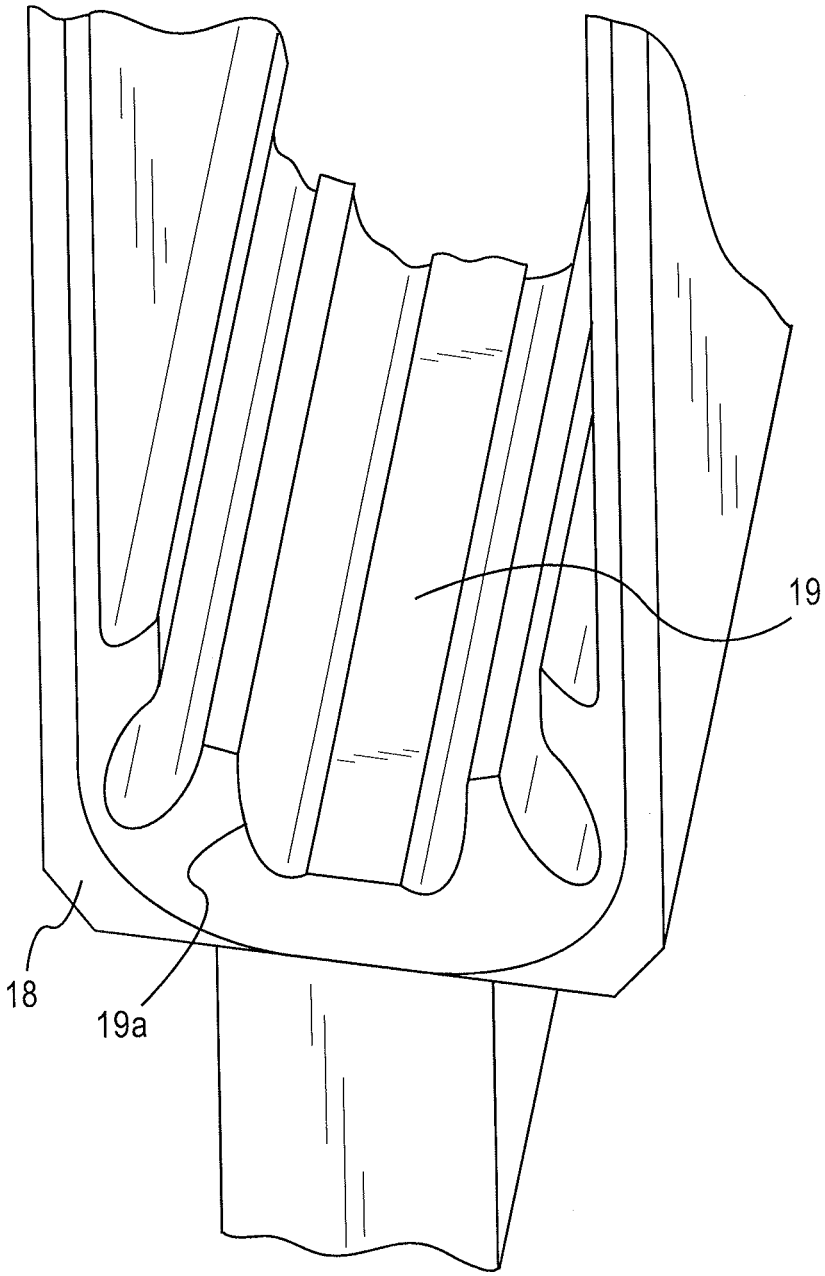
Fig.2a PRIOR ART
FIG. 2*a* shows a partial perspective view of an example related art magazine well.
Figure 2B:
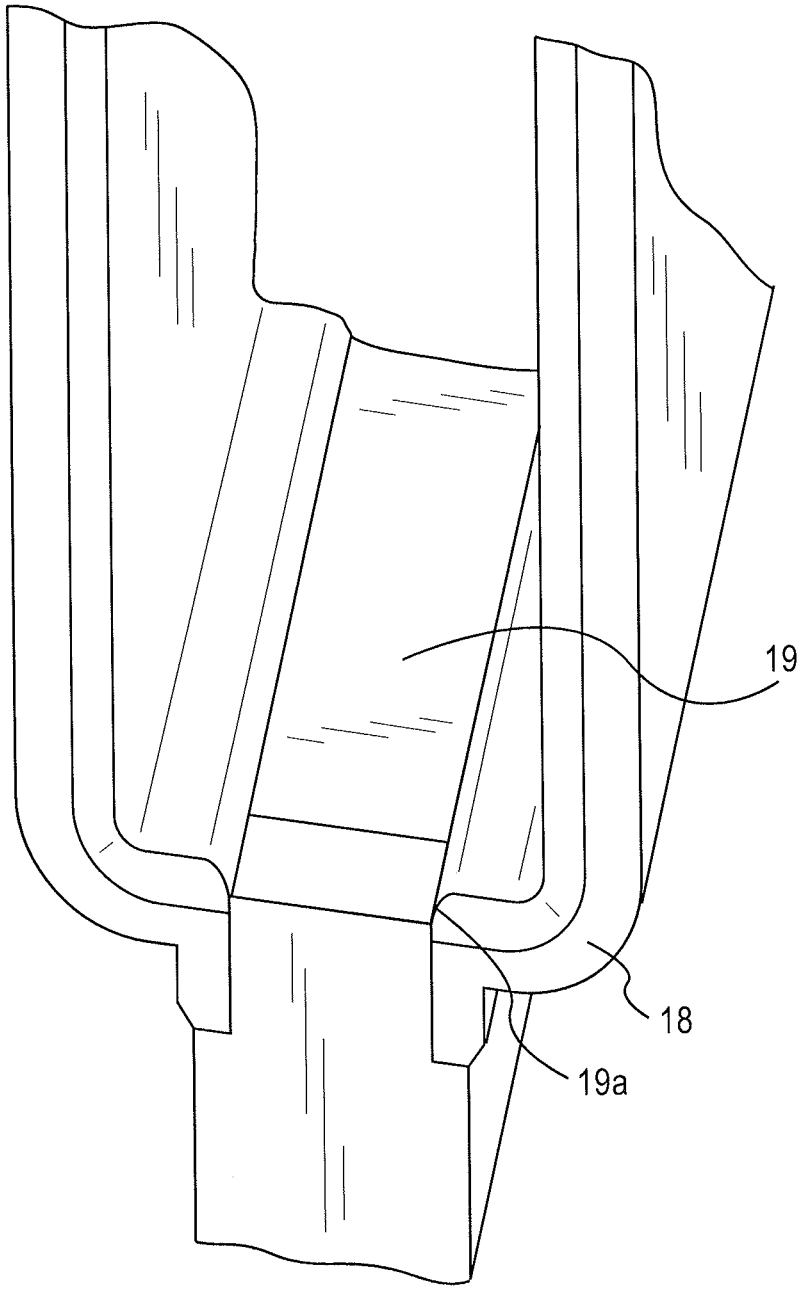
Fig.2b PRIOR ART
FIG. 2*b* shows a partial perspective view of an example related art magazine well.

As seen in FIG. 1, example firearms usable win accordance with aspects of the present invention typically include a magazine well 18 sized to receive a magazine 20. When an operator is ready to load a fresh magazine 20 into the magazine well 18, the operator first ejects the empty magazine present within the magazine well 18 by pressing the magazine release button 46, for example. Pressing the magazine release button 46 may release the magazine catch 44 such that the empty magazine falls out of the magazine well 18 due to gravity or other force, or is removed by hand. Then, the operator places a new magazine 20, into the magazine well 18 by lining up a spine of the magazine 20 with a spine receiving portion inside the magazine well 20. FIGS. 2*a* and 2*b* show a close up internal view of two example related art magazine wells 18, each having a magazine spine receiving portion 19. As shown in FIGS. 2*a* and 2*b*, the receiving portions 19 have generally straight edges 19*a*. Because of this edge, in the related art firearms, when the operator is attempting to line up the magazine 20 with the magazine well 18, if the operator does not precisely align the magazine 20 with the receiving portion 19 to match the angle 19*c*, the magazine 20 will not easily enter the magazine well 18. During the pressure of battle or competition, it may be difficult for the operator to ensure that the magazine 20 is properly aligned with the receiving portion 19. If the operator attempts to load the magazine 20 at the improper angle, and the magazine 20 does not slide into the magazine well 20, the operator will have to take the time to adjust the magazine 20 to be properly angled with the receiving portion 19. Even a few seconds of adjustment time can result in serious bodily harm or death in battle. Additionally, in the related art magazine wells, the side wall flaring only extends approximately 0.250 inches into the depth of the magazine well, which is less than 15% of the depth.

Figure 3:
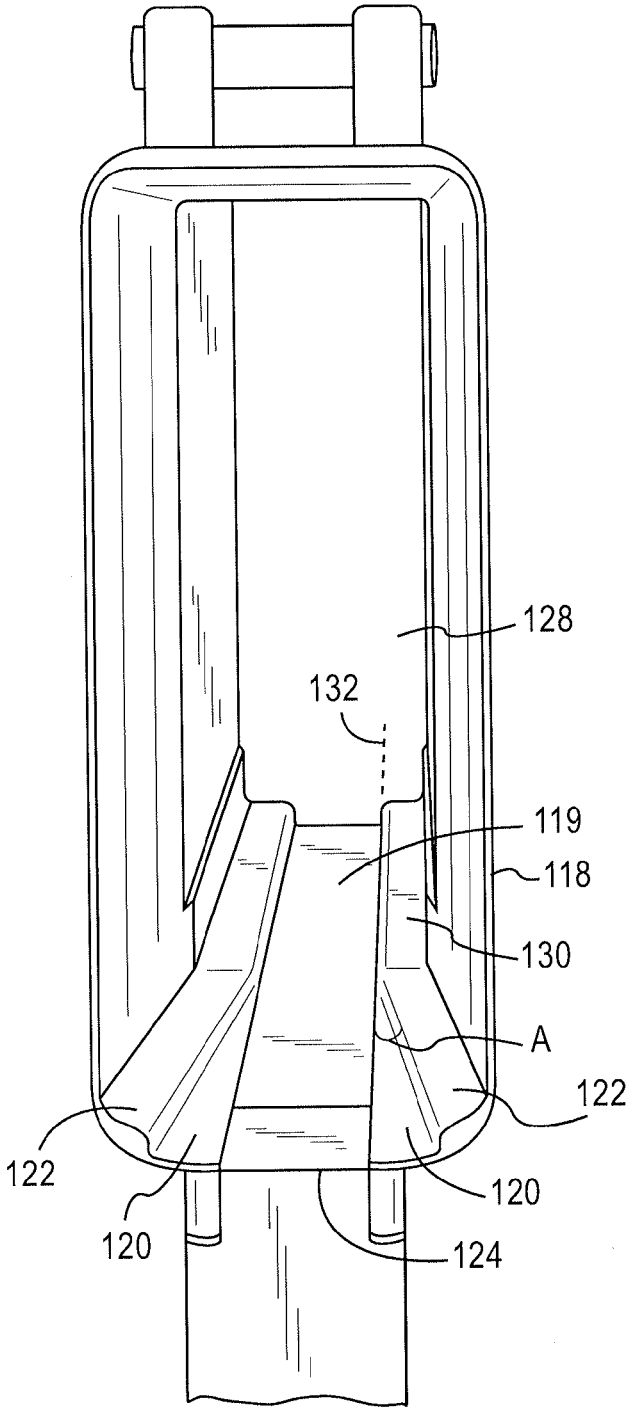
FIG. 3 shows a perspective view of a magazine well in accordance with aspects of present invention.

FIG. 3 shows a magazine well 118 in accordance with aspects of the present invention. The magazine well 118 includes a plurality of walls that define a cavity for receiving a magazine. The magazine well includes a magazine spine receiving portion 119 extending along one of the walls. The magazine well 118 of the present invention receives a portion of a magazine. The magazine well 118 may include an angled portion 120 and a curved portion 122. As shown in FIG. 3, the angled portion 120 may comprise a ramp. Starting from the input end 124 of the magazine well 118, the ramp increases in width relative to side wall 126 in a direction toward the end 128 opposing the input end 124. A non-angled portion 130 of receiving portion 119 defines a longitudinal line 132. The non-angled portion extends from the ramp and along the wall of the magazine well having the spine receiving portion. As shown in FIG. 3, the angled portion 120 forms an angle A relative to the longitudinal line 132. The ramp forms angle A relative to the longitudinal line 132 provides significant latitude for the operator to insert a magazine into the magazine well 118. Therefore, the angled portion is angled relative to the longitudinal line 132 that extends along the wall of the magazine well having the spine receiving portion.

As compared to related magazine wells, the operator no longer has to precisely align the magazine, and in particular, the spine of the magazine, with the receiving portion. Rather, if the operator attempts to insert the magazine at an angle, such that the spine is angled relative to the longitudinal line 132, the angled portion/ramp 120 provides ample adjustment room and serves as a guide to allow the operator to quickly arrive at the proper alignment. That is, even when the magazine enters at significant angle, such as 30 degrees relative to the longitudinal line 132, the operator simply needs to continue pushing the magazine and the angled portion/ramp 120 will guide the magazine to the non-angled portion 130 of the receiving portion 119. Then, upon continued application of force, the magazine will easily follow the proper alignment into the non-angled portion 130. The angle A may range from greater than 0° to 90° (e.g., no ramp), in another aspect, 1° to 60°, in another aspect 10° to 40°, and in another aspect 15° to 30°. It also within the scope hereof, that the ramp 120 may be curved, such as having a parabolic cross-sectional shape.

As shown in FIG. 3, in an aspect of the present invention, about one fifth of the length of the receiving portion 119 may comprise the angled portion 120. Thus, of the entire length of the receiving portion 119, one fifth of the length, starting from the input end 124, may be angled. It is within the scope hereof that about one eight to about one third of the length of the receiving portion may comprise the first angled portion. In another aspect of the invention, about one sixth to about one fourth of the length of the receiving portion may comprise the first angled portion. In yet another aspect of the present invention, the angled portion 120 of the receiving portion may be omitted entirely. For example, instead of the receiving portion having the angled portion, the receiving portion may extend along only a portion of the magazine well and terminate, leaving a portion of the magazine well with no receiving portion.

As shown in FIG. 3, the magazine well 118 may further include a curved or beveled surface 122. The curved surface 122 may be formed on a portion of the receiving portion 119 near the input end 124 of the magazine well 118. The direction of the curvature may be generally in a direction parallel to the longitudinal line 132 and toward the magazine input end 124. Therefore, the amount of curvature of the beveled/curved surface increases in a direction parallel to the longitudinal line 132 and toward the input end of the magazine well. The curved surface 122 allows for greater insertion angles for similar reasons discussed above with respect to the angled portion 120. When the operator attempts to insert the magazine at an angle that is not well aligned with the receiving portion 119, for example, the curvature assists the entry into the magazine well by guiding the portion of the magazine that contacts the curved surface 122 along the curve towards the proper positioning. As shown in FIG. 3, the curved surface 122 may be combined with the angled portion 120. For example, the curved surface 122 may be formed at the narrow end of the angled portion 120 near the input end 124. When both features are implemented in a magazine well, the features may work together to smoothly and comfortably guide the magazine toward the proper position to slide within the receiving portion 119.

Figure 4:
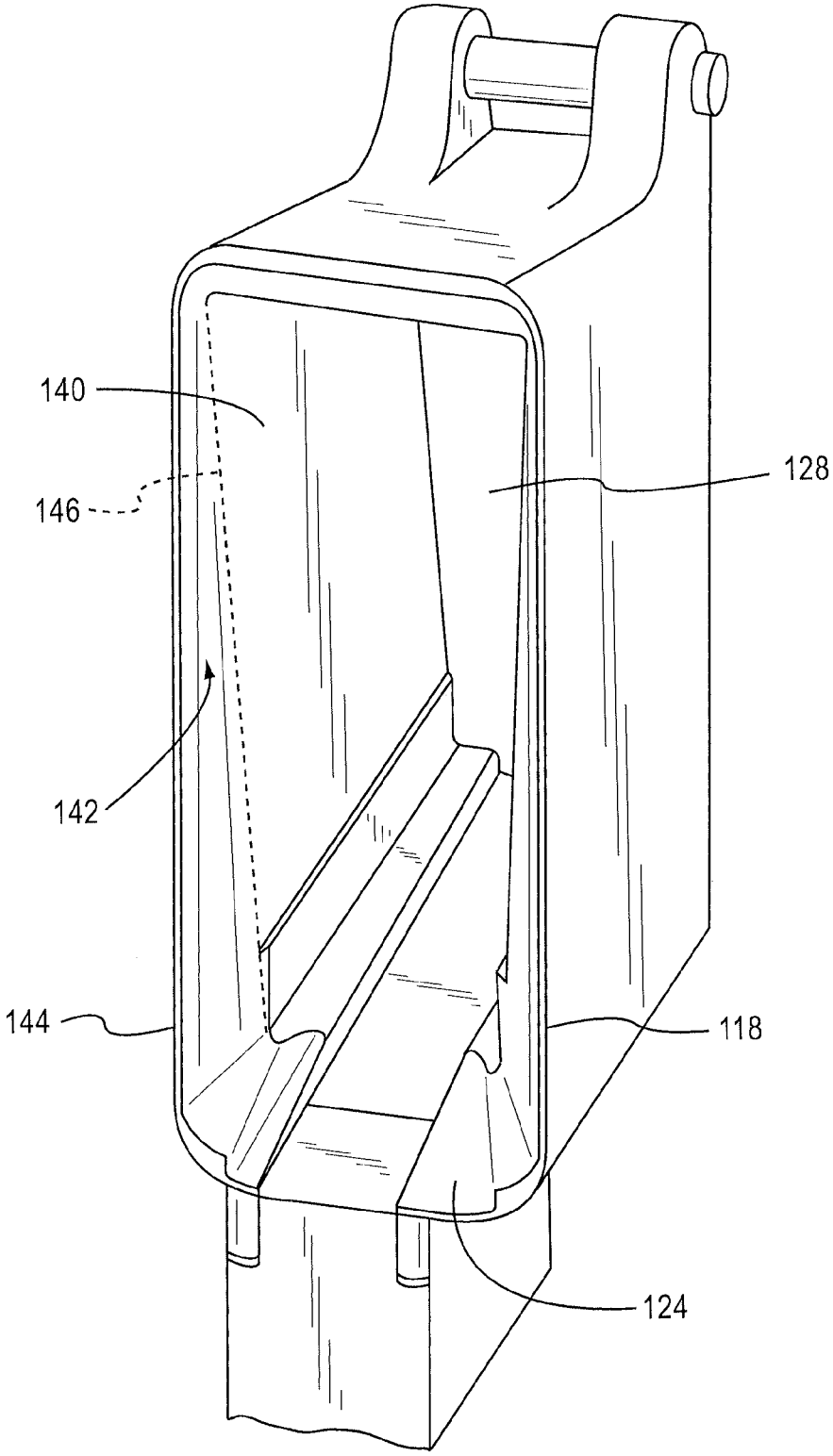
FIG. 4 shows a perspective view of a magazine well in accordance with aspects of the present invention.

It will be appreciated that the first and second angled portions 120, 122, may be applied to magazine wells having other features that do not interfere with the angled portions. For example, other ramps or flaring that does not interfere with the first and second angled portions 120 may be combined in a single magazine well. As shown in FIG. 4, in an aspect of the present invention, the magazine well 118 may include a flared sidewall 140. At least a portion 142 of the flared sidewall 140 may extend from an edge 144 of the sidewall into the depth of the magazine well by about 5-75%. For example, the flared sidewall 140 may extend greater than 0.250 inches from the edge 144 into the depth of the magazine well. In another aspect, the flared sidewall may extend 20-35% or more into the depth of the magazine well, preferably 10-30%. As shown in FIG. 4, the extent to which the flaring portion 140 extends into the depth of the magazine well may increase in a direction toward the well wall having the spine receiving portion. Additionally, as shown in FIG. 4, the flaring may be provided in an asymmetric manner such that there is more relief on the rear of the magazine well (when the firearm is in level firing orientation). This is shown by the imaginary line 146, where the portion 142 is defined by the edge 144 and the imaginary line 146. The portion of the inner surface of the magazine well 118 may include the flared sidewall 140. For example, in a typical magazine well having four walls combined into a generally rectangular shape to define a cavity, the inner surface of up to all of the four walls may include flaring, preferably on the two side walls perpendicular to the spine receiving wall. A magazine well having the above-described flaring on these two opposing walls thus has a trapezoidal or substantially trapezoidal shaped inner perimeter. The flaring may also act as a ramp and may increase in thickness toward the end 128 opposing the input end 124. The flaring 140 may further add guidance during insertion of the magazine into the magazine well, and further allow for greater insertion angles. The flaring 140 may act in conjunction with the ramp 120 and both may be present in a single magazine well.

It should be understood that the above-described magazine well is applicable to any firearm configured to receive a magazine in the manner described above. Example direct impingement type firearms include: PredatAR™ and OBR™ sold by LaRue Tactical, LAR-15™ sold by Rock River, ST-15 sold by Spike's Tactical, M4 sold by BCM, M400™ sold by Sig Sauer, CTR-02™ sold by JP Enterprises, M4 sold by Daniel Defense, X8 sold by Next Generation Arms, TS3 sold by Vltor, 308MWST™ and MRP™ Defender sold by LMT, ORC© sold by Bushmaster, M-4, M-16, and R-15™ sold by Remington, SR-15 and SR-25 sold by Knight's Armament Co., M-4, M-16, and LE6920 sold by Colt, C7 and C8 sold by Colt Canada, STAG-15 sold by Stag Arms, LR308™ and Sportical™ sold by DPMS, M&P™ 15 sold by Smith & Wesson, AR-10 and M-15 sold by Armalite, MMR™ sold by O.F. Mossberg, and N4 and N6 sold by Noveske Rifleworks. Example piston type firearms include: SIG516, SIG556, and SIG716 sold by Sig Sauer, MRP Defender Piston™ sold by LMT, HK416, HK417, MR556, and MR762 sold by Heckler & Koch, SCAR™-16S/L/17S/-H sold by FNH USA, ACR™ sold by Bushmaster, ACR™ sold by Remington, M6 sold by LWRC, XCR sold by Robinson Armament, and SR556® sold by Ruger.

Charging Handle

As seen in FIG. 1, related art firearms may include a charging handle 32. Charging handles and their operation are well known in the related art. In summary, the charging handle 32 is a device on a firearm that engages the bolt carrier 26, and when operated, pulls the bolt carrier 26 to the rear and cocks the hammer 66. Allowing the charging handle 32, along with the bolt carrier 26, to move forward, strips the top round from the magazine and loads the round in the chamber. This action is necessary if, for example, the bolt is closed when a fresh magazine is inserted. Pulling back and releasing the charging handle 32 loads the first cartridge. The actuation of the charging handle is also necessary when a cartridge fails to fire. Pulling back and releasing the charging handle ejects the problem cartridge and loads a new one. The charging handle 32 may have a latch 62 that is biased inwardly by a spring 64, thereby maintaining the charging handle 32 in a locked position. When an operator applies force to the latch 62, such as in a pivoting manner, in order to overcome the spring force of the spring 64, the latch 62 disengages, and the charging handle 32 is free to be pulled toward the rear of the firearm.

Related art charging handles, such as the charging handle shown in FIG. 1, typically have several problems. Notably, during operation of direct impingement type firearms, such as an AR-15, gas is exhausted through available spaces. One of these spaces if formed between the charging handle and the upper receiver. Thus, when related charging handles are used, exhaust gas escaping through the space between the charging handle and upper receiver blows directly toward the operator's eyes. Another problem with related art charging handles is that the latch may extend from the left side of the charging handle and be actuated by pushing toward the rear of the handle. The amount of force applied to the latch in high stress situations can be excessive. Applying this force to the latch in the manner required by related art charging handles puts significant strain on the charging handle body, and can cause the charging handle to bend or break within the firearm.

Figure 5:
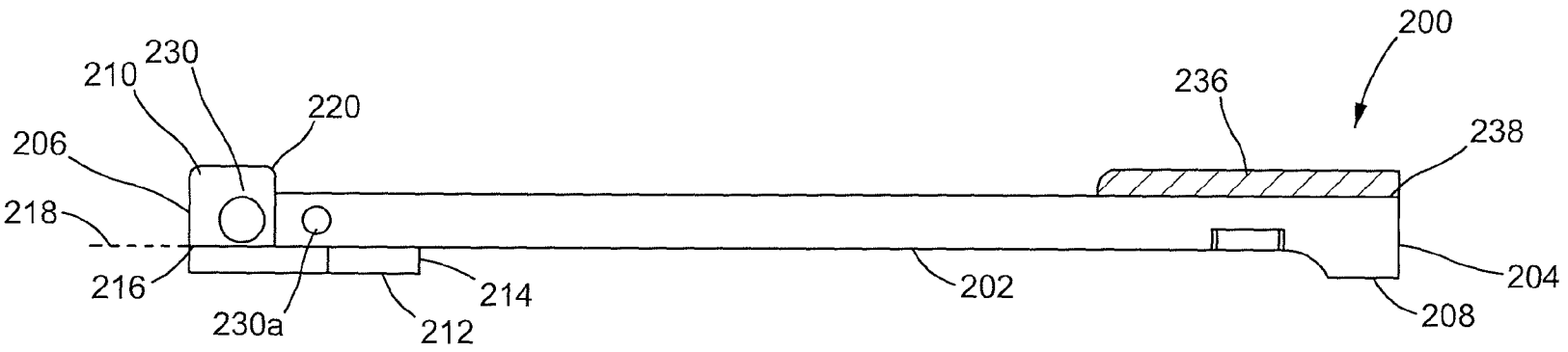
FIG. 5 shows a side view of a charging handle in accordance with aspects of the present invention.
Figure 6:
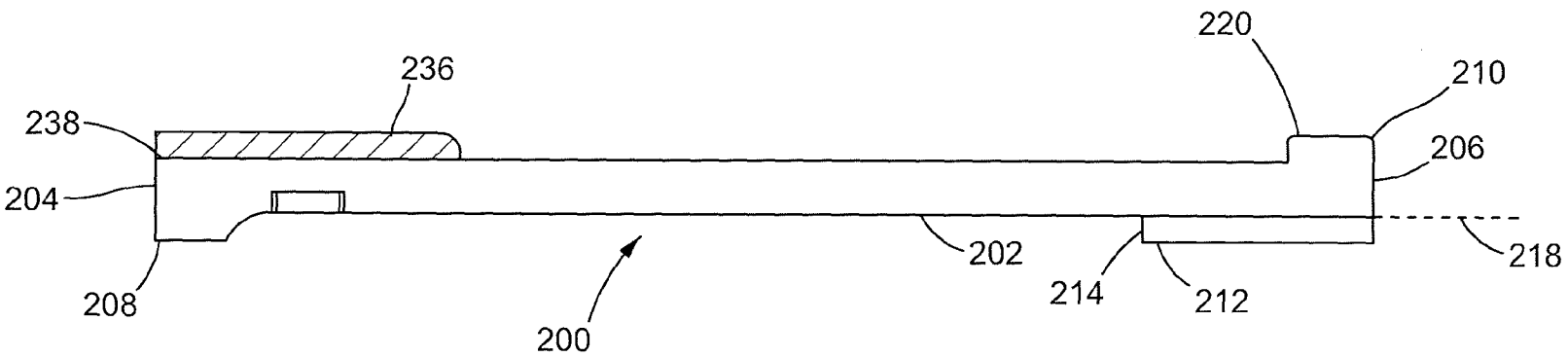
FIG. 6 shows the opposing side view of the charging handle of FIG. 5.
Figure 7:
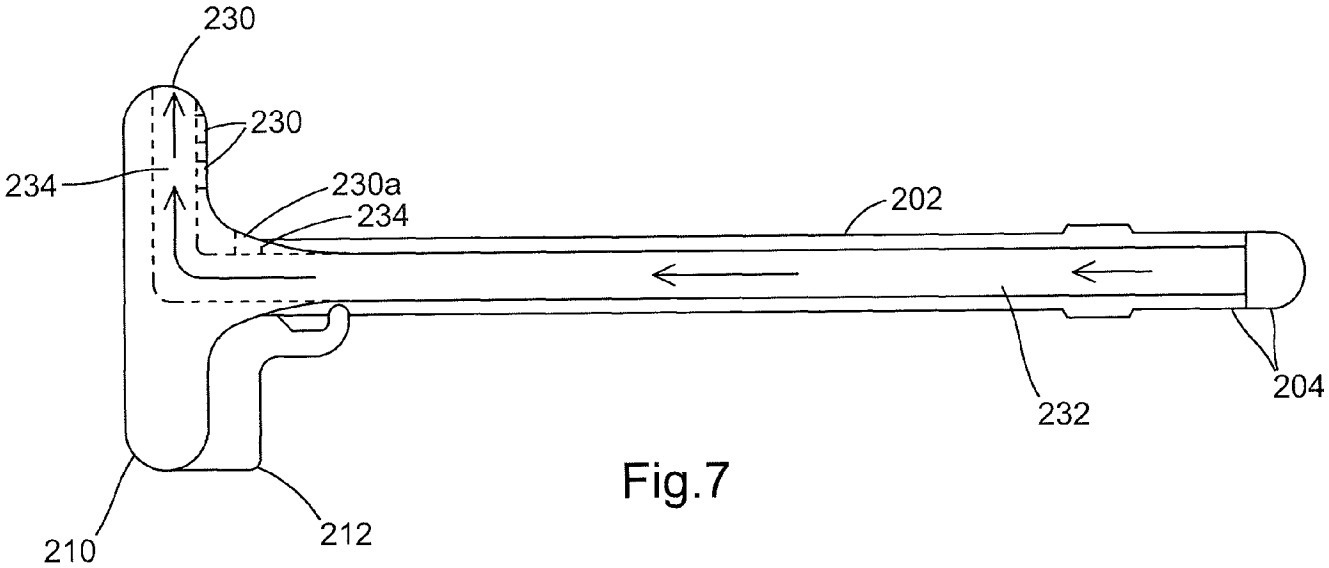
FIG. 7 shows a bottom view of the charging handle of FIG. 5.
Figure 8:
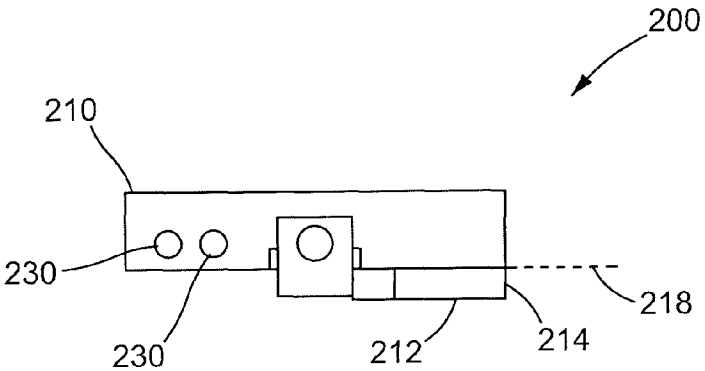
FIG. 8 shows a front view of the charging handle of FIG. 5.

FIGS. 5-9 show various views of a charging handle 200 in accordance with aspects of the present invention. FIG. 5 shows a side view of a charging handle 200. The charging handle 200 may include a body 202 that extends between a front end 204 and a rear end 206. At the front end 204, the charging handle 200 may include a hook 208 that engages a bolt. At the rear end 206, the charging handle 202 may include a crossbar 210. A bottom surface of the crossbar 210 defines a horizontal plane 218. The rear end 206 further includes a latch 212. The latch 212 may be operatively connected to the body 200 via a pin and spring similar to the related the art. In a conventional charging handle, as shown in FIG. 1, the latch is generally flat to be flush with the horizontal plane 218. As best shown in FIGS. 5, 7, and 8, the latch 212 in accordance with aspects of the present invention may include an extending portion 214 that extends below the horizontal plane 218. This extension 214 of the latch provides a much easier way for the operator to grab the latch 212 and pull the charging handle 200 rearward (relative to the barrel), without causing undue stress on the charging handle 200. The latch 212 has a larger surface area than the typical related art latches, which decreases pressure on the operator's fingers, reduces risk of impinging the operator's ribs or stomach when the weapon is slung, and reduces the likelihood of a finger being pinched, among other advantages.

Figure 9:
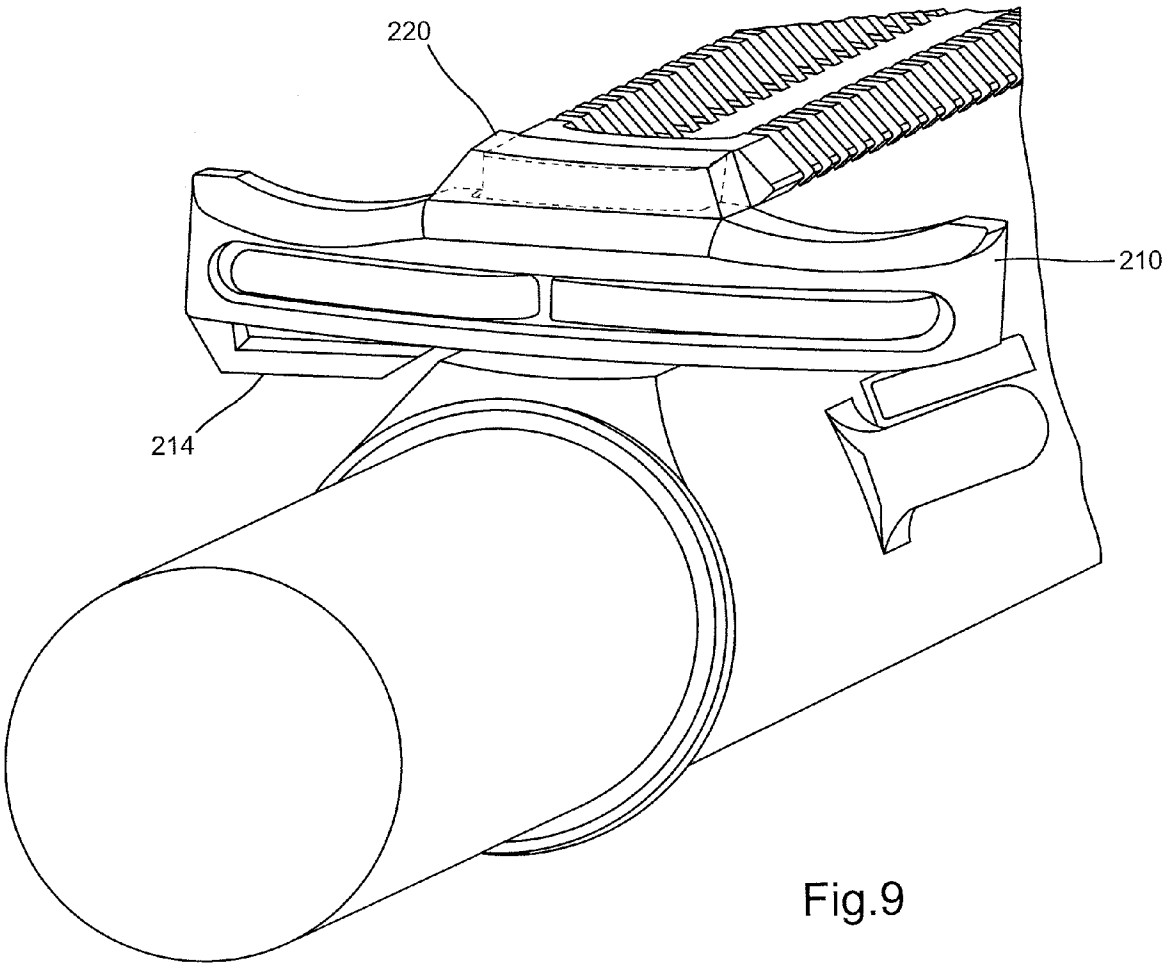
FIG. 9 shows a perspective view of a charging handle engaged with a firearm, in accordance with aspects of the present invention.

As shown in FIGS. 5, 6, and 9, the charging handle 200 may further include a diverter 220. The diverter 220 may project from a portion of the crossbar 210. As best seen in FIG. 9, the diverter 220 may be shaped to correspond with a portion of the upper receiver that is adjacent to the crossbar 210 when the charging handle 200 is fully inserted into the firearm. The diverter 220 may extend upwardly above the upper receiver (when the firearm is in level firing orientation) from the crossbar 210 (e.g., away from the horizontal plane defined by the bottom surface of the crossbar) and outwardly toward the front end 204. The diverter 220 may be thus configured to receive or block gas that escapes from the space formed between the charging handle and the upper and lower receivers, and divert the gas away from the operator's eyes and away from any optics that may be installed on the firearm. The diverter 220 may have a straight or curved perimeter, for example.

As shown in FIGS. 5, 7, and 8, the charging handle 200 may further include one or more vents 230. As shown in FIG. 7, gas may flow along a channel 232 formed within the bottom surface of the body 202 of charging handle 200. The channel 232 provides a space to for the gas to travel in a controlled manner. The charging handle 200 may further include a bore 234 formed within the crossbar 210. The bore 234 may communicate with the channel 232, allowing the gas to pass from the body 202 to the crossbar 210. The bore 234 may be shaped to communicate with one or more vents 230. Each of the vents 230 provides a pathway to release the gas fin a direction that does not interfere with the operator or other parts of the firearm, such as optics, for example. For example, as shown in FIGS. 5, 7, and 8, the vents 230 may be formed on a portion of the crossbar 210 that is not connected to the latch 212. When exiting the charging handle 200 through the vents 230 formed within the crossbar 210, the gas may travel in a direction toward the front end 204. At least one of the vents 232 formed within the crossbar 210 may also direct gas in a direction substantially perpendicular to the longitudinal axis of the body 202. The one or more vents 230 may also include a vent 230*a* formed in the body 202 that directs gas in a direction substantially perpendicular to the longitudinal axis of the body 202. As shown in FIG. 7, the vent 230*a* may open toward the side of the charging handle that does not include the latch 212.

As shown in FIGS. 6 and 7, the charging handle 200 may include a raised portion 236 on an upper surface of the body 202, starting from the front end 204 and extending toward the rear end 206. The raised portion 236 may comprise an increased thickness of the body 202, for example over 0.300" in height or 0.400" in width, that reduces wobble when the charging handle is inserted into the firearm. The raised portion 236 also blocks gas and debris during the firing process. The raised portion 236 further allows for additional surface area to distribute contact forces, while strengthening the handle. The thickness of the raised portion 236 may approximate the thickness the contact portion 238. The contact portion 238 is present in related art charging handles. The raised portion may extend along the entire length of the body 202 to the rear end 206. This raised portion 238 improves stability of the charging handle within the upper receiver.

Figure 10:
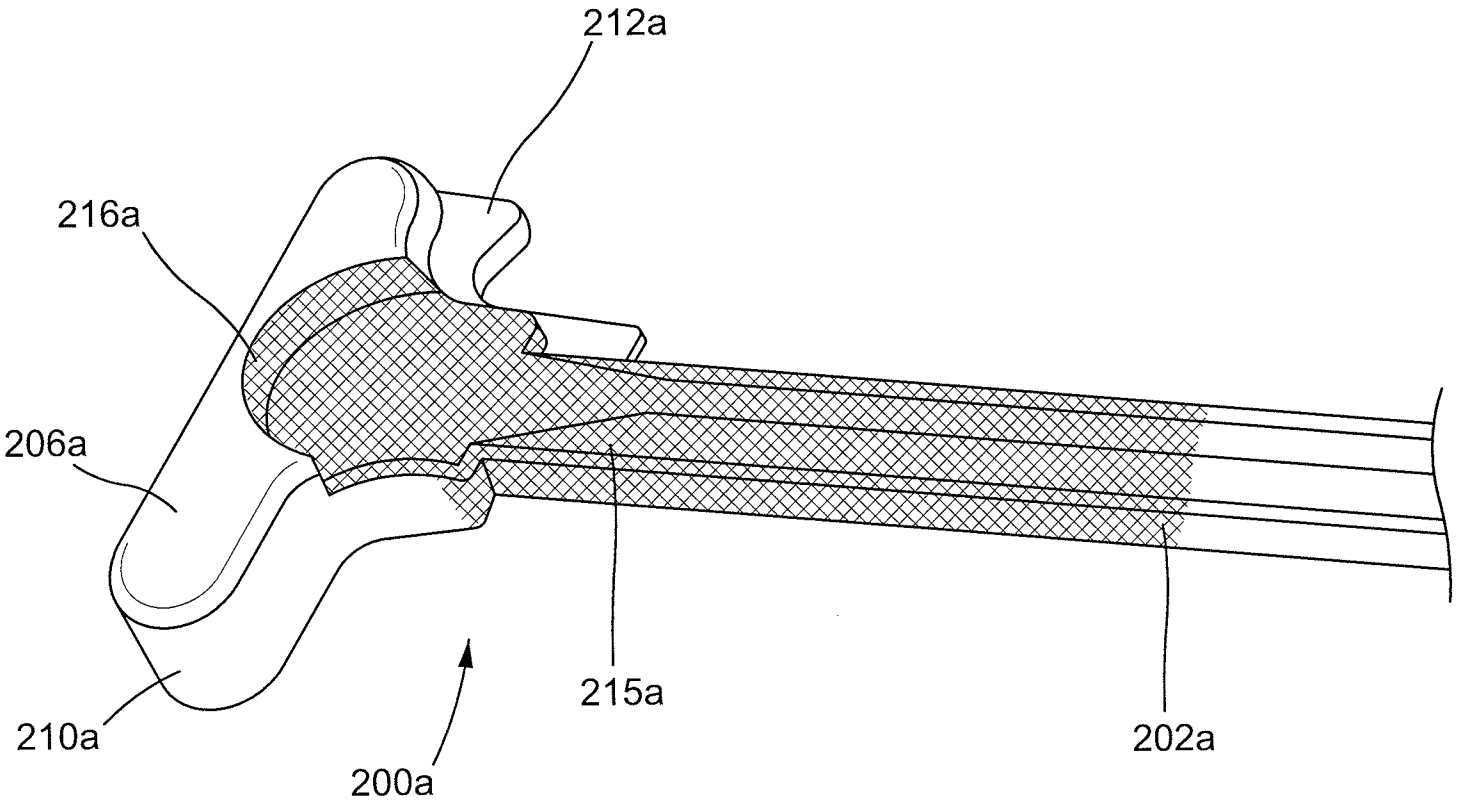
FIG. 10 shows a partial perspective view of a charging handle in accordance with aspects of the present invention.

In another aspect of the invention, a permanent or semi-permanent material layer of brass, copper, aluminum, or other suitable material may be applied to a portion of the charging handle, or to the upper or lower receiving openings proximate to where the charging handle is inserted. As shown in FIG. 10, the charging handle 200*a* may have similar structure described above, including a main body 202*a*, a rear end 206*a*, a cross bar 201*a*, and a latch 212*a*. The charging handle 200*a* may include any of the above-described features of the charging handle 200. The charging handle 200*a* may further include a material layer 215*a*. As shown in FIG. 10, the material layer 215*a* may begin at the curvature 216*a* of the cross bar 201*a* (e.g., at the rear end 206*a*) and extend along the main body 202*a* toward the front end (not shown). The layer may extend approximately ⅙ to ⅔ the length of the main body, preferably about ¼ to ⅓ the length of the main body. In another aspect, the entire main body may be covered in the material layer. Further, the material layer may extend around the entire circumference of the main body or may be provided just on an upper surface, for example. By providing the layer on this portion of the charging handle, when the changing handle is inserted into the firearm, the layer acts as a horizontal fill-in that extends into the upper receiver of the firearm and blocks gas before it exits the upper receiver and into the shooter's eyes. Thus, the thickness of the layer may be any amount suitable to extend into the upper receiver sufficient to block gas. For example, the thickness of the layer may be about 0.001" to about 0.020", more preferably 0.0012" to about 0.010", most preferably 0.0015" to about 0.004".

It should be understood that the above-described charging handle is applicable to any firearm configured to receive a charging handle in the manner described above. Example direct impingement type firearms include: PredatAR™ and OBR™ sold by LaRue Tactical, LAR-15™ sold by Rock River, ST-15 sold by Spike's Tactical, M4 sold by BCM, CTR-02™ sold by JP Enterprises, TS3 sold by Vltor, M4 sold by Daniel Defense, X8 sold by Next Generation Arms, M400 sold by Sig Sauer, 308MWS and MRP Defender sold by LMT, ORC sold by Bushmaster, M-4, M-16, and R-15 sold by Remington, SR-15 and SR-25 sold by Knight's Armament Co., M-4, M-16, and LE6920 sold by Colt, C7 and C8 sold by Colt Canada, STAG-15 sold by Stag Arms, LR308 and Sportical sold by DPMS, M&P15 sold by Smith & Wesson, AR-10 and M-15 sold by Armalite, MMR sold by O.F. Mossberg, and N4 and N6 sold by Noveske Rifleworks. Example piston type firearms include: SIG516, and SIG716 sold by Sig Sauer, HK416, HK417, MR556, and MR762 sold by Heckler & Koch, M6 sold by LWRC, MRP™ Defender Piston sold by LMT, Evo and Elite sold by Adams Arms, LAR-PDS™ sold by Rock River, P415 sold by POF USA, and SR556® sold by Ruger.

Bolt Carrier

During operation of direct impingent type firearms, such as the AR-15 shown in FIG. 1, gas travels down the gas tube 36, which is located above the barrel 24. The gas tube 36 protrudes into a bolt carrier key 48 which allows the gas to into the bolt carrier 26. The bolt 28 and bolt carrier 26 together act as a piston, which moves as the bolt carrier 26 is filled with gas. The bolt 28 is incapable of movement because it is locked to barrel extension 50. Therefore, when the bolt carrier 26 is filled with gas, the bolt carrier 26 is forced backward, toward the buttstock 12. A cam pin 52, riding in a slot on the bolt carrier 26, forces the bolt 28 to turn and unlock from the barrel extension 50. Once the bolt 28 is unlocked, the bolt 28 moves rearward along with the bolt carrier 26. The rearward motion of the bolt 28 extracts an empty cartridge case from the chamber, and a spring-loaded ejector 54 forces the cartridge out the ejection port 56. Behind the bolt carrier is a plastic or metal buffer 58 which rests in line with a return spring 60 that pushes the bolt carrier 26 back toward the chamber. A groove of the upper receiver traps the cam pin 52 and prevents it and the bolt 28 from rotating into a closed position. The locking lugs of the bolt 28 then push a fresh round from the magazine, which is guided by feed ramps into the chamber. As the bolt's locking lugs move past the barrel extension, the cam pin is allowed to twist into a pocket milled into the upper receiver.

This twisting action follows the groove cut into the carrier and forces the bolt to twist and "lock" into the barrel's unique extension.

Figure 11:
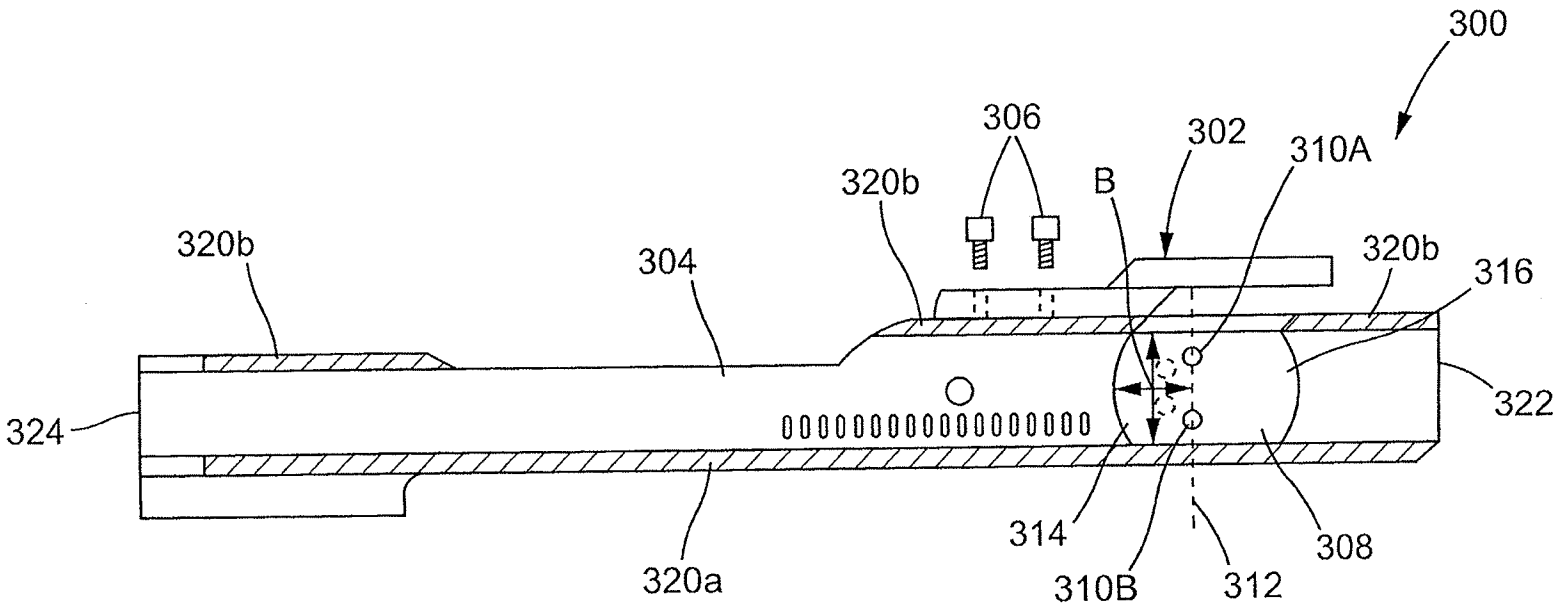
FIG. 11 shows a side view of a bolt carrier in accordance with aspects of the present invention.

FIG. 11 shows a side view of a bolt carrier 300 in accordance with aspects of the present invention. The bolt carrier 300 may include a bolt carrier key 302, which is connected to a main body 304 via screws 306. The main body 302 may also include an indented portion 308 this includes vent holes 310*a*, 310*b*. As shown in FIG. 11, the vent hole 310*a* may be disposed above vent hole 310*b*. An imaginary line 312 passing through the two vent holes 310*a*, 310*b* separates the indented portion 308 into a first portion 314 to the left of line 312 (toward the barrel of the firearm) and a second portion 316 to the right of line 312 (toward the buttstock of the firearm). In an aspect of the present invention, the bolt carrier 300 may include one or more additional vents provided anywhere in the first portion 314 of the indented portion 308, designated "B" in FIG. 11. Placing one or more vents in the portion 314 allows more time during the firing process for gas to vent. In particular, at the point during operation of the firearm when the bolt carrier is traveling toward the rear of the firearm, gas is exhausted. However, because this motion occurs very quickly, and/or may vary with the round fired, there may be insufficient time for an appropriate amount of gas to be vented out of holes 310*a*, 310*b*. Adding additional vent holes in the first portion 314 provides more vent time (as well as greater vent path) by decreasing the acceleration of the bolt carrier and therefore provides opportunity for gas to sufficiently exhaust from the bolt carrier. This operation thereby prevents undesired gas from going back into the receiver. The vents may also be provided in other portions of the bolt carrier and firearm. For example, one or more vents may be included in the gas key 302, a gas tube (not shown), and/or in a gas block (not shown). The gas block is a feature in a piston type firearm while the gas key is a feature of an direct impingement firearm.

In accordance with aspects of the present invention, the bolt carrier 300 may also include one or more rails 320*a*, 320*b* that may extend along the length of the main body 304, such as on each side of the bolt carrier. The rails 320*a*, 320*b* include a portion of material that is thicker than other portions of the main body 304, thereby acting as a contact point when the bolt carrier reciprocates. As shown in FIG. 11, one rail 320*a* may be disposed on a side surface of the main body 304 near the bottom of the body 304. The rail 320*a* may extend continuously from a rear end 322 of the bolt carrier 300 to the front end 324 of the bolt carrier 300, for example. In another aspect, each of the rails 320*a*, 320*b* may be split up into any number of non-continuous pieces. Similarly, the rail 320*b* may be disposed on a side surface near the top of the main body 304, for example. Due to the structure of the bolt carrier 300, the rail 320*b* may be segmented into multiple portions. For example, the indented portion 308 may not need rails because it is indented and will not contact the firearm during reciprocation. In another aspect, however, the indented portion 308 may also include rails along a top portion (e.g., so that 320*b* is continuous across the indented portion 308). The rail portion being provided along the indented portion keeps sand or grit from entering the upper receiver. The opposing side of the bolt carrier may also include rails disposed in similar positions as shown in FIG. 11. In another aspect of the present invention, instead of including rails, the corresponding portions of the main body (i.e., the portions on which the rails are shown in the figures), may have a size that is equivalent in diameter to the diameter of the combined main body and rails. In other words, the same effect of the rails may be achieved by increasing the diameter of the main body.

Other aspects of the bolt carrier 300 may include pads and/or skids that extend longitudinally along the bolt carrier (e.g., in the same direction that the rails 302*a*, 302*b* extend). The addition of pads and/or skids may increase stability during operation. Additionally, the rails 302*a*, 302*b* may include one or more sand cuts. A sand cut provides an interruption in the rail which decreases the tolerance between moving parts, allowing them to fit closer together. The rails may include angled portions, such as a plow shape, on the front and back edges, to cut through fouling. The rails 302*a*, 302*b* may also include sand cuts. Sand cuts provide a place for fouling to go without disturbing the interaction between moving parts. The body of the bolt carrier or bolt may also include sand cuts. In particular, the exterior of the body of the blot carrier or bolt adjacent to inner surfaces of the upper receiver. Similarly, a plurality of sand cuts may be included along any internal surface of an upper receiver that contacts or is in close proximity/adjacent to the bolt carrier. In another aspect of the present invention, an inner surface of the upper receiver that is adjacent to the outer surface of the bolt carrier may include a recess to provide additional clearance. In another aspect, on the same surface, instead of or in addition to the recess, longitudinal grooves (e.g., grooves extending in a direction substantially parallel to a longitudinal axis of the cavity that receives the bolt carrier) or transverse grooves (e.g., grooves extending in a direction substantially perpendicular to the longitudinal axis of the cavity that receives the bolt carrier) or any angled groove in between longitudinal or transverse directions.

It should be understood that the above-described bolt carrier is applicable to any firearm configured to utilize a bolt carrier in the manner described above. With respect to the rails and/or pads, example direct impingement type firearms include: PredatAR™ and OBR™ sold by LaRue Tactical, ST-15 sold by Spike's Tactical, LAR-15® sold by Rock River, CTR-02™ sold by JP Enterprises, M4 sold by Daniel Defense, X8 sold by Next Generation Arms, M4 sold by BCM, M400 sold by Sig Sauer, 308MWS and MRP Defender sold by LMT, ORC sold by Bushmaster, M-4, M-16, and R-15 sold by Remington, SR-15 and SR-25 sold by Knight's Armament Co., M-4, M-16, and LE6920 sold by Colt, C7 and C8 sold by Colt Canada, STAG-15 sold by Stag Arms, LR308 and Sportical sold by DPMS, M&P™ 15 sold by Smith & Wesson, AR-10 and M-15 sold by Armalite, MMR sold by O.F. Mossberg, and N4 and N6 sold by Noveske Rifleworks. Example piston type firearms include: SIG516, and SIG716 sold by Sig Sauer, BEAR sold by Adcor, Mk 11x and Mk 21x sold by Primary Weapons Systems, LAR-PDS™ sold by Rock River, Evo and Elite sold by Adams Arms, HK416, HK417, MR556, and MR762 sold by Heckler & Koch, M6 sold by LWRC, and SR556 sold by Ruger.

With respect to the vent holes disposed in the indented portion, example direct impingement type firearms include: PredatAR™ and OBR™ sold by LaRue Tactical, ST-15 sold by Spike's Tactical, LAR-15 sold by Rock River, M400 sold by Sig Sauer, CTR-02™ sold by JP Enterprises, M4 sold by Daniel Defense, X8 sold by Next Generation Arms, 308MWS and MRP™ Defender sold by LMT, ORC sold by Bushmaster, M-4, M-16, and R-15™ sold by Remington, SR-15 and SR-25 sold by Knight's Armament Co., M-4, M-16, and LE6920 sold by Colt, C7 and C8 sold by Diemaco, STAG-15 sold by Stag Arms, LR308 and Sportical sold by DPMS, M&P™ 15 sold by Smith & Wesson, AR-10 and M-15 sold by Armalite, MMR sold by O.F. Mossberg, and N4 and N6 sold by Noveske Rifleworks.

With respect to vent holes disposed in the gas block, example piston type firearms include: SIG516, SIG556, and SIG716 sold by Sig Sauer, HK416, HK417, MR556, and MR762 sold by Heckler & Koch, Mk 11x and Mk 21x sold by Primary Weapons Systems, Evo and Elite sold by Adams Arms, P415 sold by POF USA, and SCAR™ sold by FNH USA. With respect to the vent holes disposed in the gas key or gas tube, example of direct impingement include: PredatAR™ and OBR™ sold by LaRue Tactical, LAR-15 sold by Rock River, ST-15 sold by Spike's Tactical, M4 sold by BCM, M400 sold by Sig Sauer, 308MWS and MRP Defender sold by LMT, ORC sold by Bushmaster, M-4, M-16, and R-15 sold by Remington, SR-15 and SR-25 sold by Knight's Armament Co., M-4, M-16, and LE6920 sold by Colt, C7 and C8 sold by Diemaco, STAG-15 sold by Stag Arms, LR308 and Sportical sold by DPMS, M&P15 sold by Smith & Wesson, AR-10 and M-15 sold by Armalite, MMR sold by O.F. Mossberg, and N4 and N6 sold by Noveske Rifleworks.

Bolt Catch

A related art bolt catch 38 is shown in FIG. 1. Operation of such a bolt catch is known in the art. In operation, after pulling the charging handle backwards, the operator presses on the bottom of the bolt catch. After engaging the bolt with the bolt catch, and returning the charging handle to a forward position (relative to the barrel 24), the operator presses an upper portion of the bolt catch 38. When optics are installed on a firearm, it can become very difficult for the operator to access the bottom and top portions of the bolt catch 38, for example, because the optics block access for the entire hand to be used to quickly engage the bolt catch. Instead, with a related art bolt catch, for example, when optics are present, the operator must take the time to use the thumb to particularly press the button on the bolt catch.

Figure 12A:
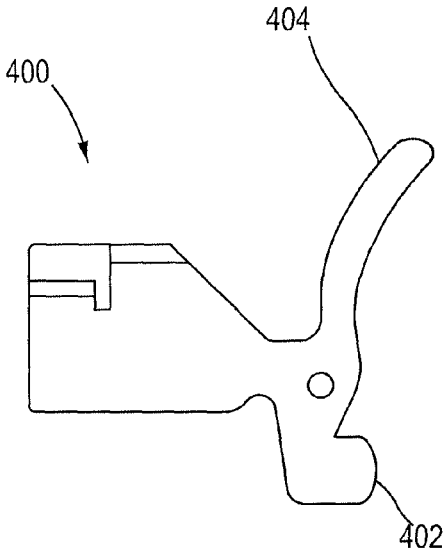
FIG. 12*a* shows a side view of a bolt catch in accordance with aspects of the present invention.
Figure 12B:
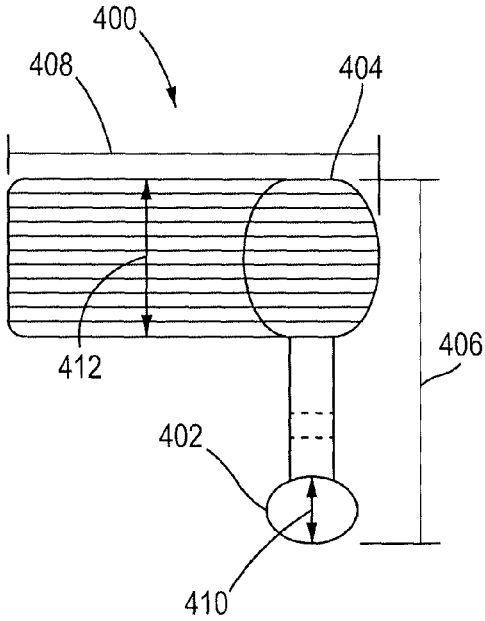
FIG. 12*b* shows a front view of the bolt catch of FIG. 11*a;*

FIG. 12*a* shows a side view of a bolt catch 400 in accordance with aspects of the present invention, and FIG. 12*b* shows a front view of the bolt catch 400. The bolt catch 400 may include a release mechanism 402, such as a button, for example, disposed at the bottom of the bolt catch 400, and a receiving portion 404 disposed, for example, at the top of the bolt catch 400. As seen in FIG. 12*a*, the receiving portion 404 may be curved to match the contour of a human thumb. As shown, the receiving portion 404 may be curved or angled outwardly away from the body of the firearm. By curving the receiving portion 404, the top of the bolt catch is angled away from the body of the firearm making it easier to actuate. Furthermore, by matching the contour of a human thumb, the operator can quickly and easily find the receiving portion 404 by feel. While illustrated as being curved, the receiving portion 404 may be angled away from the body of the firearm when the bolt catch is in a forward position. That is, the receiving portion 404 is angled relative to the body of the firearm after the receiving portion 404 has been pressed toward the body of the firearm. In this position, the angle may be greater than 1°, in another aspect 1° to 60°, in another aspect 5° to 40°, and in another aspect 15° to 30°.

Figure 13:
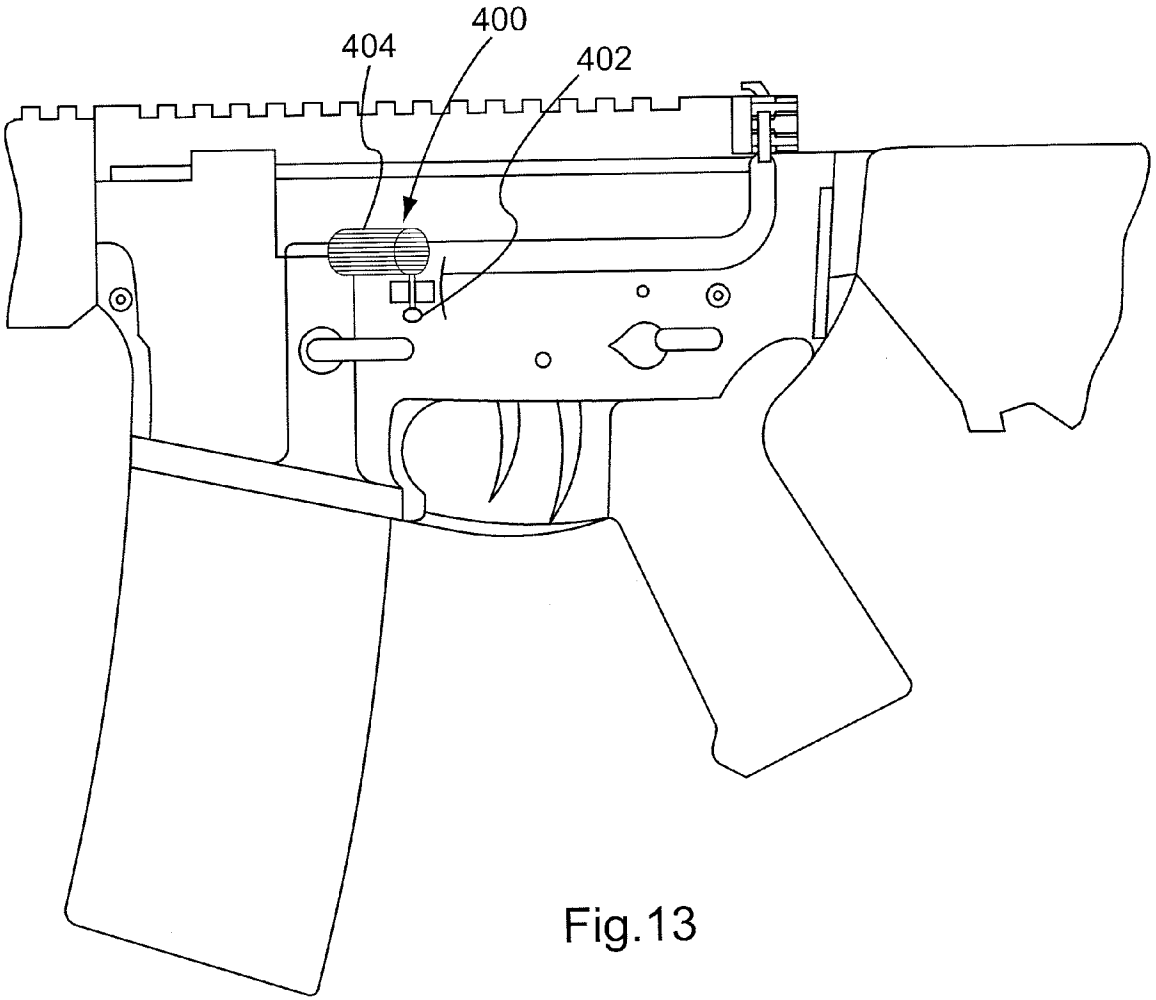
FIG. 13 is a side view of a firearm having the bolt catch of FIG. 11*a;*

Additionally, as shown in FIG. 12*b* and FIG. 13, the receiving portion 404 may have length 408 that extends toward the front of the barrel of the firearm when the bolt catch 400 is installed in the firearm. In an aspect of the present invention the length 408 of the receiving portion 404 may be approximately equal to the distance 406 between the top of the bolt catch 400 and the bottom of the bolt catch 400 (when the firearm is in a level firing position). In another aspect of the present invention the length 408 may be from half the distance 406 up to twice the distance 406. The length 408 allows a user to easily find and actuate the receiving portion 404 of the bolt catch.

As shown in FIG. 12*b*, the button 402 may also be enlarged relative to a conventional button to allow easier actuation. For example, in a conventional bolt catch, the height of the button is approximately one eighth to one fifth the size of the height of the receiving portion. For example, conventional buttons are known have a height ⅛ of an inch. In an aspect of the present invention, the height 410 of the button 402 is approximately one fourth to equal the height 412 of the receiving portion 404, more preferably one half to three quarters the height 412 of the receiving portion 404. For example, the button in accordance with aspects of the present invention may be 0.130 or greater. The button 402, when in a non-actuated position, may extend about 0.125 inches or more from the body of the lower receiver in a direction perpendicular to the longitudinal axis of the firearm (when in a firing orientation). In another aspect of the present invention the height 410 of the button 402 may be greater than the height 412 of the receiving portion 404.

While the bolt catch is shown in FIGS. 12*a* and 12*b* as single unified piece, it should be appreciated that the elements of the bolt catch may be separate pieces that may be secured to a related art bolt catch. For example, one or both of the receiving portion 404 and the button 402 may be separate pieces that may include clamping features to allow the receiving portion 404 and button 402 to be clamped to a related art bolt catch.

It should be understood that the above-described bolt catch is applicable to any firearm configured to utilize a bolt catch in the manner described above. Example direct impingement type firearms include: PredatAR™ and OBR™ sold by LaRue Tactical, LAR-15 sold by Rock River, ST-15 sold by Spike's Tactical, M4 sold by BCM, CTR-02™ sold by JP Enterprises, M4 sold by Daniel Defense, X8 sold by Next Generation Arms, M400 sold by Sig Sauer, 308MWS and MRP Defender sold by LMT, ORC sold by Bushmaster, M-4, M-16, and R-15 sold by Remington, SR-15 and SR-25 sold by Knight's Armament Co., M-4, M-16, and LE6920 sold by Colt, C7 and C8 sold by Diemaco, STAG-15 sold by Stag Arms, LR308 and Sportical sold by DPMS, M&P15 sold by Smith & Wesson, AR-10 and M-15 sold by Armalite, MMR sold by O.F. Mossberg, and N4 and N6 sold by Noveske Rifleworks. Example piston type firearms include: SIG516, SIG556, and SIG716 sold by Sig Sauer, MRP Defender Piston sold by LMT, HK416, HK417, MR556, and MR762 sold by Heckler & Koch, SCAR-16S, SCAR-L, SCAR-17S, and SCAR-H sold by FNH USA, ACR sold by Bushmaster, ACR sold by Remington, M6 sold by LWRC, Evo, and Elite sold by Adams Arms, AR-180 sold by Armalite, P415 sold by POF USA, and SR556 sold by Ruger.

Scope

Firearm operators often mount scopes to a firearm to assist in long distance shooting. When using a scope, it is critical that the crosshairs are aligned perfectly to allow for accurate shooting. Scope rings are generally split vertically or horizontally. Shooters will rely on distant known vertical lines, levels, etc., to align the scope properly. Examples include placing a level on the receiver and top of the scope and adjust until they are aligned, using a plumb-bob, and visually lining up the vertical axis of the reticle through the middle of the rifle stock. Among other drawbacks, this process can be time consuming.

Figure 14:
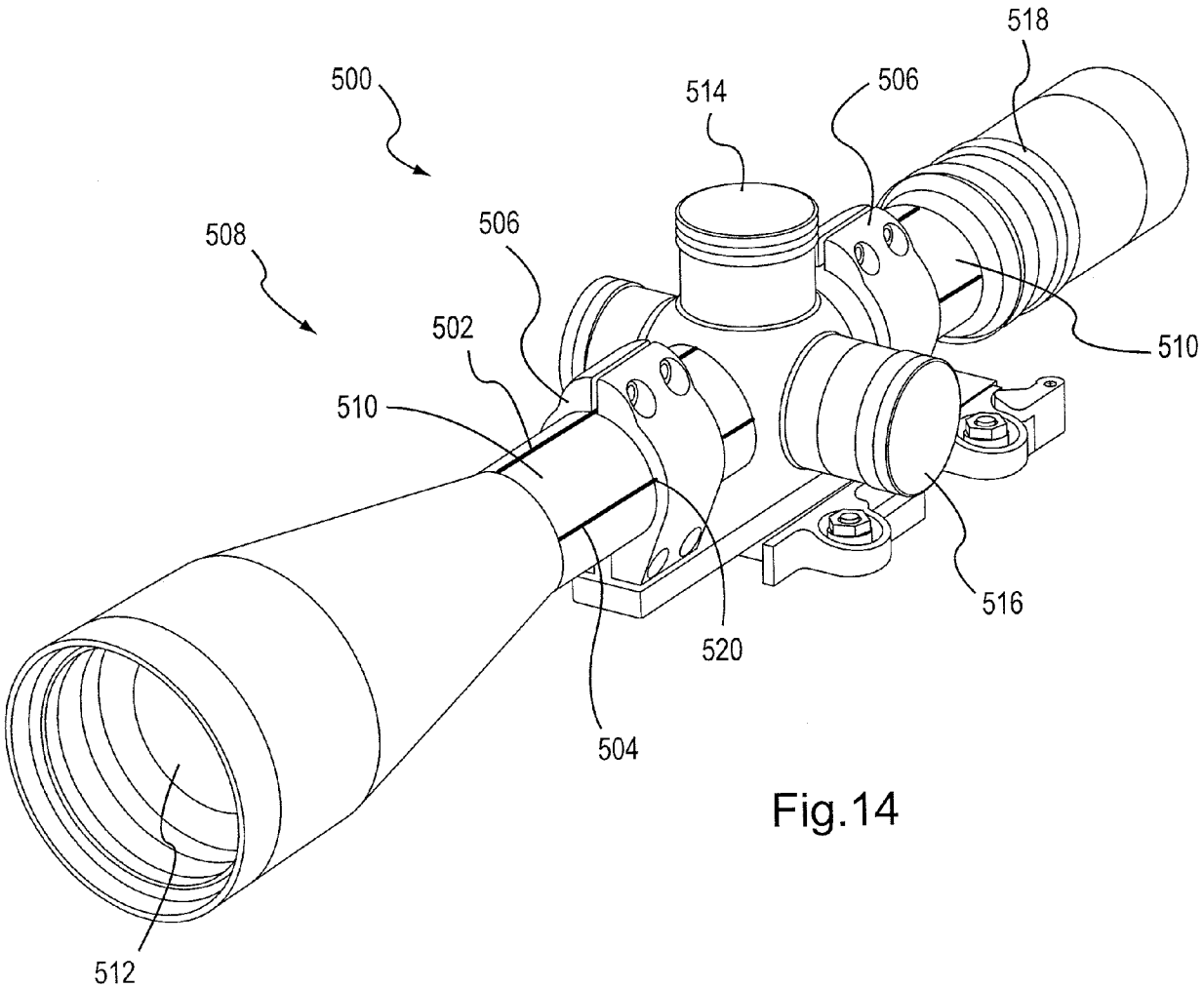
FIG. 14 is a perspective view of a scope in accordance with aspects of the present invention.

FIG. 14 shows a perspective view of a scope 500 in accordance with aspects of the present invention. The scope includes a main body 508 having a cylindrical portion 510, a lens 512 disposed within the main body, a power adjuster 518, an elevation adjuster 514, and a windage adjuster 516, each adjuster being coupled to the main body. As shown in FIG. 14, the scope 500 includes markings 502, 504 while the mount 506 may also include markings 520. Example markings shown in FIG. 14 may include a line 502 at the 12 o'clock radial position (i.e., 0 degrees) and a line 504 at the 9 o'clock radial position (i.e., 270 degrees). However, any o'clock radial position (e.g., any degree of the 360 degrees) or any radial position between o'clock radial positions (e.g., any individual degree) is suitable. The mount 506 may similarly have a corresponding marking the equivalent radial position or positions of the markings on the scope. The markings may similarly be provided on any radial position (e.g., any degree) of the mount 506.

In an aspect of the invention, the marker or markers provided on the scope may be in any radial position or positions around the scope as long as the marker or markers on the mount are also located in the corresponding radial position or positions. For example, if a marker is placed on the scope at a radial position corresponding to the 3 o'clock radial position (i.e., 90 degrees), the marker on the mount should also positioned to correspond to the 3 o'clock (i.e., 90 degrees) radial position. These lines may be etched or engraved directly into the material, may be painted on, or may be adhered to the scope and mount. The markings may be any size sufficient to allow the operator to perceive the markings by sight or touch. The operator may adjust the scope by aligning the marking on the scope with the corresponding marking on the mount. For example, if a marking is located at the 2 o'clock (i.e., 60 degrees) radial position the operator would align the 2 o'clock (i.e., 60 degrees) marking of the scope with the 2 o'clock (i.e., 60 degrees) marking of the mount.

It should be understood that the above-described scope is applicable to any firearm configured to utilize a scope or optical sight in the manner described above. Other classes of firearms such as hunting rifles, shotguns, pistols, and machine guns are also applicable, as are crossbows or other weapons that use a scope or optical device.

Cleaning Device

Figure 15:
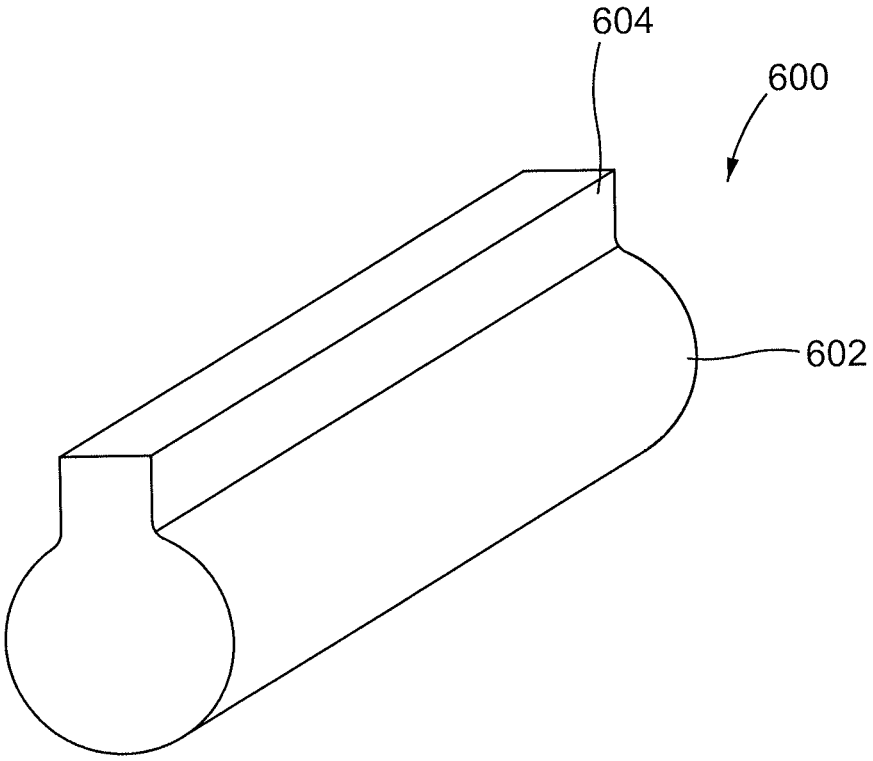
FIG. 15 is a perspective view of a cleaning device in accordance with aspects of the present invention.

FIG. 15 shows a perspective view of a cleaning device 600 in accordance with aspects of the present invention. The cleaning device 600 may include a main body 602 and a projecting portion 604 that extends upwardly from the main body 602 (relative to a firearm in a level firing position). As shown in FIG. 15, the main body 602 may include a generally elongated cylindrical shape, and the projection portion 604 may have a generally elongated rectangular shape having a square cross section. The cleaning device 600 may be shaped to correspond with the internal shape of an upper receiver of the firearm. By being shaped to correspond with the internal shape of the upper receiver, an operator may easily insert the cleaning device 600 into the upper receiver and ensure that all of the internal surfaces of the upper receiver are contacted by the cleaning device 600 during the cleaning process. The cleaning device 600 may be formed from aluminum or any other suitable material.

When cleaning the firearm, the operator may cover the cleaning device 600 with a disposable wipe, such as a paper towel. The disposable wipe should be sufficiently flexible so that when the cleaning device 600, along the wipe, is inserted into the upper receiver of the firearm, the wipe will flex to fit within the contours of the upper receiver. After several cleaning strokes, the operator may remove the cleaning device 600 from the upper receiver and dispose of the wipe. If the upper receiver needs further cleaning, the operator may wrap the cleaning device 600 with a new wipe and reinsert the cleaning device 600 into the upper receiver. These steps can be repeated until the upper receiver is satisfactorily cleaned. The cleaning device 600 may be used in variety of firearms, including an AR-10, an AR-15 and variants, an AR-180, an HK 416, an HK MR556, an HK 417, an FN FAL, an M-4, and M-16, an FN SCAR, and a Bushmaster/Remington ACR, for example.

It should be understood that the above-described cleaning device is applicable to any firearm configured to utilize a cleaning device in the manner described above. Example direct impingement type firearms include: PredatAR™ and OBR™ sold by LaRue Tactical, LAR-15™ sold by Rock River, ST-15 sold by Spike's Tactical, M4 sold by BCM, M400 sold by Sig Sauer, 308MWS and MRP Defender sold by LMT, ORC sold by Bushmaster, M-4, M-16, and R-15 sold by Remington, SR-15 and SR-25 sold by Knight's Armament Co., M-4, M-16, and LE6920 sold by Colt, C7 and C8 sold by Diemaco, STAG-15 sold by Stag Arms, LR308 and Sportical sold by DPMS, M&P15 sold by Smith & Wesson, AR-10 and M-15 sold by Armalite, MMR sold by O.F. Mossberg, and N4 and N6 sold by Noveske Rifleworks. Example piston type firearms include: SIG516, SIG556, and SIG716 sold by Sig Sauer, MRP Defender Piston sold by LMT, HK416, HK417, MR556, and MR762 sold by Heckler & Koch, SCAR™-16S/4J-17S/-H sold by FNH USA, ACR sold by Bushmaster, ACR sold by Remington, M6 sold by LWRC, AR-180 sold by Armalite, P415 sold by POF USA, and SR556® sold by Ruger.

Bolt

Figure 16:
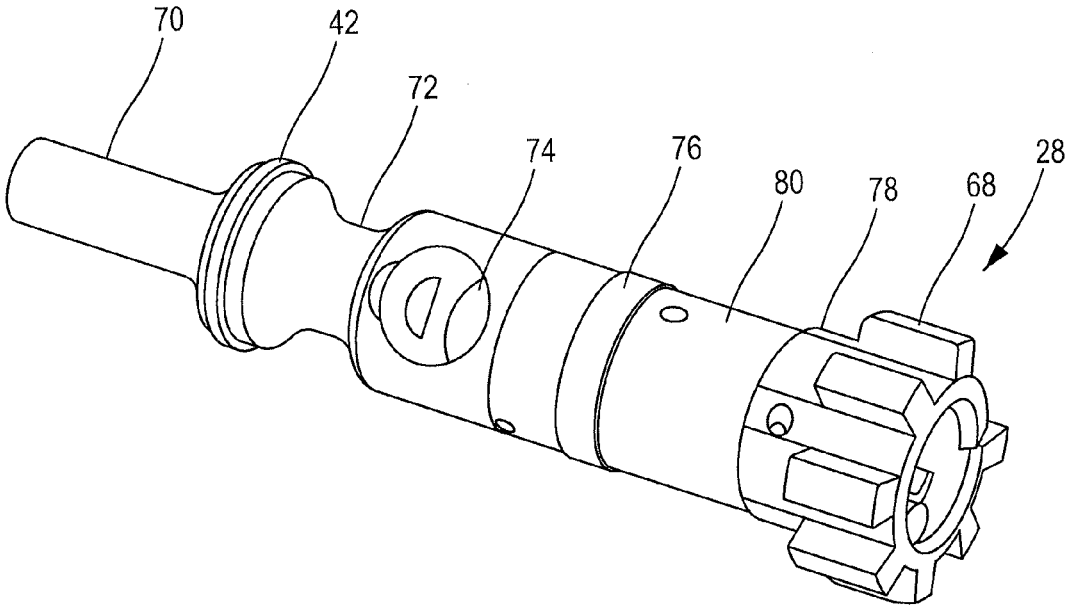
Fig.16 PRIOR ART
FIG. 16 is a perspective view of an example related art bolt.

FIG. 16 shows an example related art bolt 28. The general operation of the bolt 28 in conjunction with the bolt carrier 26 is discussed above. The related art bolt 28 includes a main body 80, rectangular lugs 68 disposed at the front end of the bolt 28 (i.e., the end closer to the barrel 24 when assembled in a firearm), ribs 78 adjacent to the lugs 68, a tail portion 70 disposed at the rear end of the bolt 28 (i.e., the end farther from the barrel 24 when assembled), a gas ring 42 adjacent to the tail portion 70, a decreased diameter portion 72 adjacent to the gas ring 42, a through hole 74 adjacent to the decreased diameter portion 72, a wear ring 76 disposed between the through hole 74 and the lugs 66. As shown in FIG. 16, in the related art bolt 28, the ribs 78, starting from the lugs 68, only extend along about one-tenth the length of the body 80 toward the rear end. Furthermore, in the related art bolt 28, the diameter of the main body 80 is 0.509 inches, the diameter of the wear ring 76 is 0.528 inches, and the diameter of the decreased diameter portion 72 is 0.313 inches. Thus, the diameter of the decreased diameter portion 72 is smaller than diameter of the main body 80 (e.g., the decreased diameter portion 72 is about 61.5% the size of the diameter of the main body 80), and is smaller than the diameter of the wear ring 76 (e.g., the decreased diameter portion 72 is about 59.3% the size of diameter of the wear ring 76). Furthermore, the diameter of the main body 80 is smaller than the diameter of the wear ring 76 (e.g., the diameter of the main body 80 is about 96.4% the size of the diameter of the wear ring 76). With this structural arrangement, in the related art bolt 28, there is too much play (wobble) between the bolt 28 and the bolt carrier 26. During the operation of the firearm (see above), significant stress is placed on the bolt 28. As a result of the play and the stress, the bolt 28 will often crack and break leading to catastrophic failure.

Figure 17:
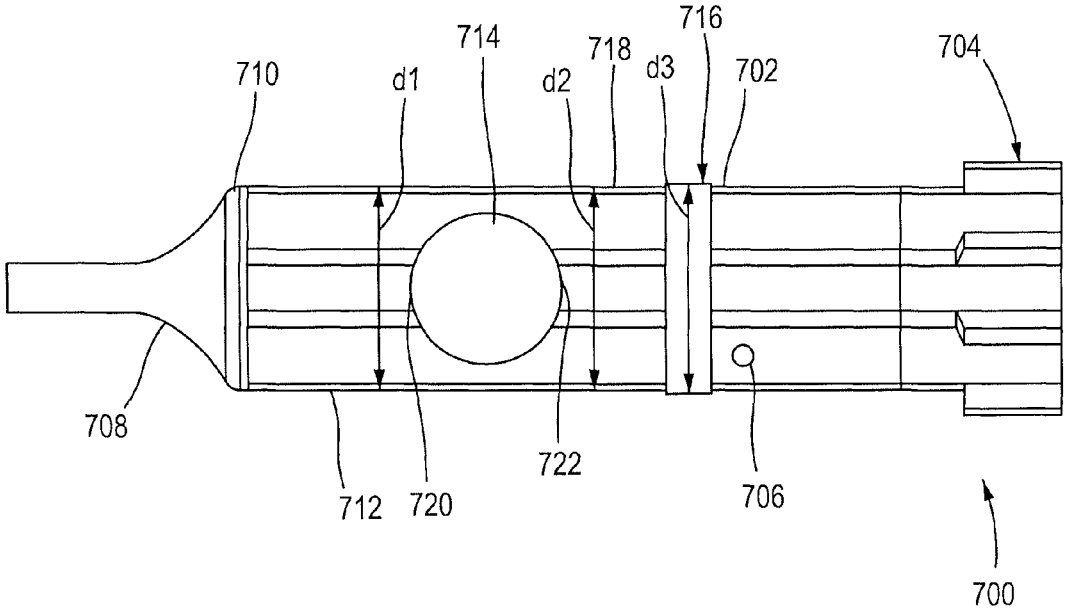
FIG. 17 is a side view of a bolt in accordance with aspects of the present invention.

FIG. 17 shows a side view of an example bolt 700 in accordance with aspects of the present invention. The bolt 700 may include a main body 702, lugs 704 disposed at the front end of the bolt 700 (i.e., the end closer to the barrel when assembled in a firearm), one or more ribs 706, a tail portion 708 disposed at the rear end of the bolt 700 (i.e., the end farther from the barrel when assembled), a gas ring 710 adjacent to the tail portion 708, a first portion 712 extending from the gas ring 710 to a rear end 720 of the a through hole 714

(i.e., the end of the through hole 714 closer to the buttstock when assembled), a second portion 718 extending from a front end 722 of the through hole 714 (i.e., the end of the through hole 714 closer to the barrel) to the one or more lugs 704, and a wear ring 716 disposed between the through hole 714 and the lugs 704. As shown in FIG. 17, the one or more ribs 706, starting from the lugs 704, may extend along the entire length of the main body 702, terminating at the gas ring 710. In another aspect, the ribs 706 may extend more than one-tenth, more than one-fifth, more than one-fourth, more than one-third, more than one-half, or more than three-quarters the length of the main body 702. The one or more ribs 706 may extend radially away from a center of the main body 702. The main body 802 is defined as the portion of the bolt 700 beginning at the gas ring 710 and extending to the one or more lugs 704.

The first portion 712 may have a diameter d1 that is greater than the diameter of the decreased diameter portion 72 of the related art bolt 28. For example the diameter d1 may be greater than about 60% (e.g., 61.5%) the size of a diameter d2 of a second portion 718 and may be greater than about 59% (e.g., 59.3%) the size of diameter d3 of the wear ring 716, such as when the diameter d1 is greater than 0.313 inches, the diameter d2 is 0.509 inches, and the diameter d3 is 0.528 inches. In another aspect, the diameter d1 may be greater than 80% the size of the diameter d2 and may be greater than about 75% (e.g., 78%) the size of diameter d3, such as when the diameter d1 is 0.415 inches, the diameter d2 is 0.509 inches, and the diameter d3 is 0.528. In yet another aspect, the diameter d1 may be 100% the size of the diameter d2, such as when both d1 and d2 are 0.509 inches.

In another aspect of the present invention, the diameter d2 may be greater than the diameter of the main body 80 of the related art bolt 28. For example, the diameter d2 may be greater than about 95% (e.g., 96.5%) the size of a diameter d3 of the wear ring 716, such as when the diameter d2 is greater than 0.509 inches and the diameter d3 is 0.528 inches. In another aspect, the diameter d2 may be 100% the size of the diameter d3, such as when both d2 and d3 are 0.528 inches. It should be understood that when the diameters d2 and d3 have this relative size, the relative size of d1 as compared to d2 may be maintained (i.e., the percentages discussed above with respect to d1 and d2 would be retained). For example, in an aspect of the present invention, diameters d1, d2, and d3 may all have approximately the same value, such as when all three are 0.528 inches.

In another aspect of the present invention, the lugs 704 may have chamfered or radial edges (not shown). The bolt my further include one or more sand cuts formed on the body of the bolt, the ribs, and/or wear rings. The sand cuts provide an interruption in the material which decreases the tolerance between moving parts, allowing them to fit closer together.

The above structure provides several advantages over the related art bolt 28. The extended length of the one or more ribs 706 may stabilize the bolt 700 within the bolt carrier by removing play (wobble) and assists in removing fouling during the bolt rotation, among other things. The relative increase of diameter d1 as compared to d2 and d3, and the relative increase of diameter d2 as compared to d3, may improve the overall strength of the bolt 700 to avoid cracking and catastrophic failure as well as reducing play (wobble). The use of chamfered or radial edges of the lugs 704 may reduce stress during the locking/unlocking process, for example.

It should be understood that the above-described bolt is applicable to any firearm configured to utilize a bolt in the manner described above. Example direct impingement type firearms include: PredatAR™ and OBR™ sold by LaRue Tactical, LAR-15™ sold by Rock River, ST-15 sold by Spike's Tactical, M4 sold by BCM, CTR-02™ sold by JP Enterprises, M4 sold by Daniel Defense, X8 sold by Next Generation Arms, M400 sold by Sig Sauer, 308MWS and MRP Defender sold by LMT, ORC© sold by Bushmaster, M-4, M-16, and R-15™ sold by Remington, SR-15 and SR-25 sold by Knight's Armament Co., M-4, M-16, and LE6920 sold by Colt, C7 and C8 sold by Diemaco, STAG-15 sold by Stag Arms, LR308™ and Sportical™ sold by DPMS, M&P™ 15 sold by Smith & Wesson, AR-10 and M-15 sold by Armalite, MMR™ sold by O.F. Mossberg, and N4 and N6 sold by Noveske Rifleworks. Example piston type firearms include: Evo, and Elite sold by Adams Arms, REC7 sold by Barrett, P415 sold by POF USA, Model 8 sold by Stag Arms, Mk 11x and Mk 21x sold by Primary Weapons Systems, and M6 sold by LWRC.

It should be understood the above-described structural elements may be formed from a single piece of material or may be formed by joining multiple pieces. For example, the rails 302*a*, 302*b*, ribs 706, among other features, may be formed from a single piece of material along with the main body (e.g., main body of the bolt or bolt carrier) or the features may be joined as separate pieces to an pre-formed main body.

Example aspects have been described in accordance with the above advantages. It will be appreciated that these examples are merely illustrative of aspects of the invention. Many variations and modifications will be apparent to those skilled in the art.

The invention claimed is:

1. A bolt carrier for a firearm, comprising:

a front end and a rear end;

a main body extending from the front end to the rear end;

an indented portion;

a pair of vent holes disposed in the indented portion and aligned such that a vertical line passes through each of the vent holes, wherein the vertical line divides the indented portion into a first portion on a side of the vertical line closer to the front end and a second portion on a side of the vertical line closer to the rear end; and at least one additional vent hole disposed on the first portion of the indented portion.

2. The bolt carrier of claim 1, further comprising a gas key connected to the main body, wherein the gas key comprises a vent hole.

3. The bolt carrier of claim 1, further comprising:

one or more rails extending along a length of the main body, wherein the one or more rails extend from a side surface of the main body.

4. The bolt carrier of claim 3, wherein the one or more rails comprise a plurality of non-continuous rail portions.

5. The bolt carrier of claim 3, wherein the one or more rail portions extend along an edge of the side surface of the main body.

6. The bolt carrier of claim 3, wherein the one or more rails comprise an upper rail disposed along an upper edge of the main body, and wherein the one or more rails comprise a lower rail disposed along a lower edge of the main body.

7. The bolt carrier of claim 3, wherein the one or more rail and main body together have a combined thickness greater than a portion of the main body not having a rail disposed thereon.

8. The bolt carrier of claim 3, wherein the one or more rails include fan cuts.

* * * * *